US007121233B2

(12) United States Patent
Kitamura et al.

(10) Patent No.: US 7,121,233 B2
(45) Date of Patent: Oct. 17, 2006

(54) CONTROL APPARATUS FOR AN INTERNAL COMBUSTION ENGINE

(75) Inventors: Tohru Kitamura, Saitama (JP); Toshihiro Yamaki, Saitama (JP); Tomio Kimura, Saitama (JP); Shohei Okazaki, Saitama (JP); Katsura Okubo, Saitama (JP); Akira Kato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 294 days.

(21) Appl. No.: 10/821,174

(22) Filed: Apr. 9, 2004

(65) Prior Publication Data

US 2004/0231617 A1 Nov. 25, 2004

(30) Foreign Application Priority Data

Apr. 16, 2003 (JP) ..... 2003-111395

(51) Int. Cl.
*F02B 3/00* (2006.01)

(52) U.S. Cl. ..... 123/27 R; 123/305; 123/198 DB; 123/295; 123/406.47

(58) Field of Classification Search ..... 123/27 R, 123/305, 481, 198 DB, 486, 295, 406.47, 123/325

See application file for complete search history.

(56) References Cited

U.S. PATENT DOCUMENTS 6,085,717 A * 7/2000 Kamura et al. ..... 123/295

FOREIGN PATENT DOCUMENTS

JP 10-196424 7/1998
JP 2000-087749 3/2000

* cited by examiner

*Primary Examiner*—Tony M. Argenbright
*Assistant Examiner*—Katrina Harris
(74) *Attorney, Agent, or Firm*—Arent Fox PLLC

(57) ABSTRACT

A control apparatus for an internal combustion engine that is capable of switching between compression ignition combustion and spark ignition combustion is provided. The control apparatus is configured to perform fuel cut. The spark ignition combustion is performed over a time period after the fuel cut. The compression ignition combustion is permitted when the time period elapses. Fuel cut decreases the temperature within the combustion chamber. According to the invention, if fuel cut is performed, the temperature within the combustion chamber is raised by the spark ignition combustion. Since the compression ignition combustion is permitted after the temperature within the combustion chamber rises, engine misfire and an increase of NOx emission are prevented. The time period is preferably determined based on the temperature within the combustion chamber immediately before the fuel cut is performed.

18 Claims, 7 Drawing Sheets

CONTROL APPARATUS FOR AN INTERNAL COMBUSTION ENGINE

BACKGROUND OF THE INVENTION

The present invention relates to an internal combustion engine capable of switching between spark ignition combustion and compression ignition combustion, and in particular relates to control for such an internal combustion engine after fuel-cut.

A compression ignition type of internal combustion engine has advantage that fuel efficiency is high because high compression ratio is achieved. Such an engine has further advantage that the amount of NOx emission is low because the combustion temperature is low.

In order to cause the compression self-ignition, the temperature of gas within a combustion chamber needs to be raised beyond a predetermined temperature. Heating of intake air or internal EGR is typically performed so as to raise the temperature within the combustion chamber.

The temperature within the combustion chamber may not reach the predetermined temperature, for example, when the engine load is low. If the temperature within the combustion chamber is lower than the predetermined temperature, engine misfire may occur even when the piston reaches the top dead center (TDC). In order to prevent such engine misfire, the engine combustion is switched to spark ignition when the temperature within the combustion chamber is low, as described in the Japanese Patent Application Unexamined Publication (Kokai) No. 2000-87749.

Fuel cut, which temporarily cuts fuel supply to the engine, may be performed in response to deceleration of the vehicle. Such fuel cut decreases the temperature within the combustion chamber and the temperature of exhaust gas used for internal EGR. If the engine combustion is switched to compression ignition after the fuel-cut, the temperature within the combustion chamber may not reach a temperature required for the compression self-ignition. Even if operating conditions of the engine are within a range where the compression ignition combustion is allowed, engine misfire may occur because the temperature within the combustion chamber is low.

Thus, there is a need for technique that prohibits the compression ignition combustion if the temperature within the combustion chamber immediately after fuel-cut does not reach a predetermined value that is required for the compression self-ignition.

SUMMARY OF THE INVENTION

According to one aspect of the invention, a control apparatus for an internal combustion engine that is capable of switching between compression ignition combustion and spark ignition combustion is provided. The control apparatus comprises a control unit configured to perform a fuel cut in accordance with operating conditions of the engine. The control unit performs the spark ignition combustion over a predetermined time period after the fuel cut. The control unit permits the compression ignition combustion after the predetermined time period elapses.

If fuel cut is performed, the temperature within the combustion chamber decreases. According to the invention, the temperature within the combustion chamber is raised by the spark ignition combustion. Since the compression ignition combustion is permitted after the temperature within the combustion chamber rises, the compression ignition combustion can be performed without causing engine misfire.

According to one embodiment of the present invention, the above predetermined time period is determined based on the temperature within the combustion chamber immediately before the fuel cut is performed.

According to one embodiment of the present invention, the temperature within the combustion chamber is estimated based on the engine rotational speed and the engine torque requested by a driver. Alternatively, the temperature within the combustion chamber may be detected by a sensor.

As the temperature within the combustion chamber is lower, duration time of the spark ignition combustion needs to be longer so as to warm up the combustion chamber. According to one embodiment of the present invention, the above predetermined time period is set so that the predetermined time period is longer as the temperature within the combustion chamber immediately before the fuel cut is performed is lower. Thus, the compression ignition combustion can be performed without causing engine misfire.

As duration time of the fuel cut is longer, the temperature within the combustion chamber is lower. According to one embodiment of the present invention, the above predetermined time period is set in accordance with duration time of the fuel cut. Thus, the compression ignition combustion can be performed without causing engine misfire.

DESCRIPTION OF THE PREFERRED EMBODIMENTS

Preferred embodiments of the present invention will be now described referring to the accompanying drawings.

Figure 1:
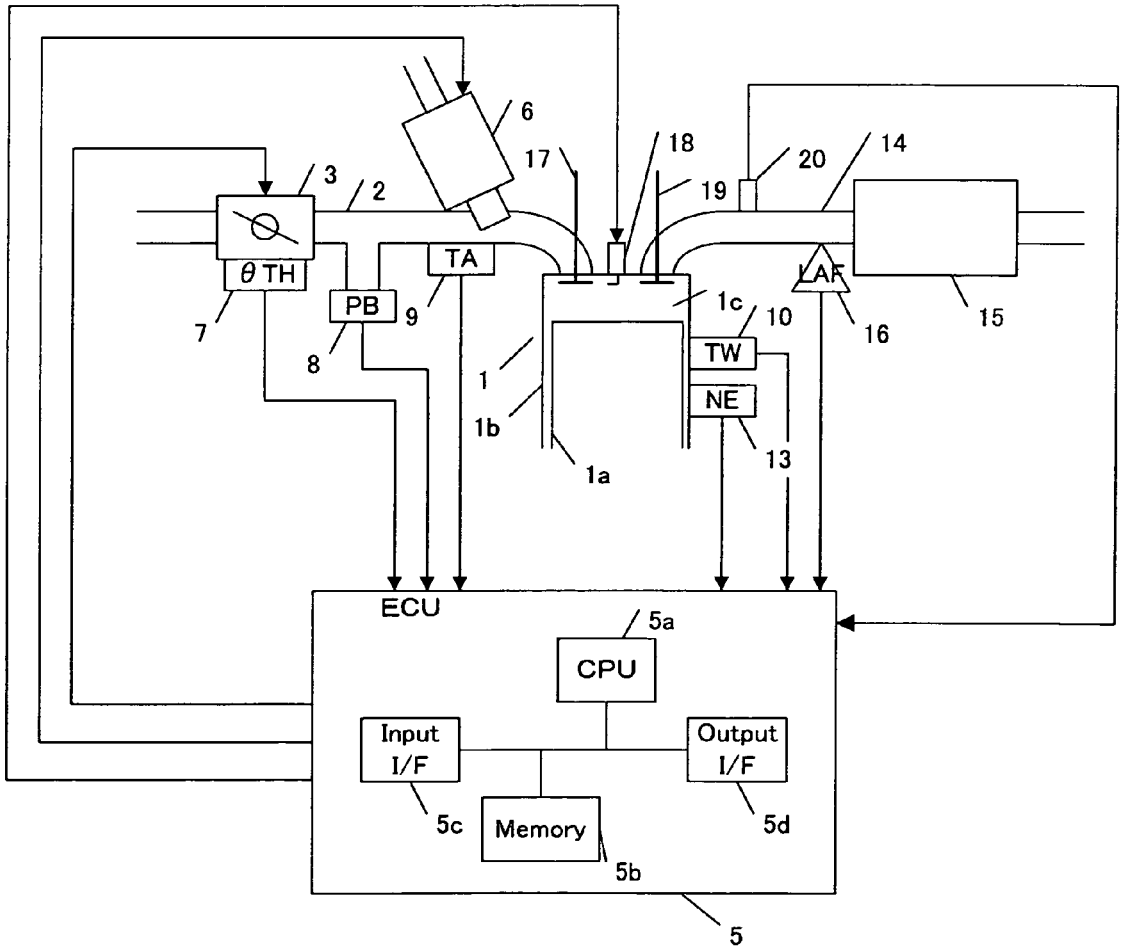
FIG. 1 is a block diagram of an internal combustion engine in accordance with one embodiment of the present invention.

FIG. 1 is a block diagram of an internal combustion engine in accordance with one embodiment of the present invention. An internal combustion engine (hereinafter referred to as an "engine") 1 is an inline four-cylinder engine, among which one cylinder is shown in FIG. 1. The engine is capable of switching between homogeneous charge compression ignition combustion (hereinafter referred to as "HCCI combustion") and spark ignition combustion (hereinafter referred to as "SI combustion"). The engine 1 comprises a piston 1*a* and a cylinder 1*b*. A combustion chamber 1*c* is formed between the piston and the head of the cylinder. A spark plug 18 is attached in the combustion chamber 1*c*. The spark plug 18 is ignited in accordance with a signal from an electronic control unit (hereinafter referred to as an "ECU") 5 when the SI combustion is performed. The structure of the ECU 5 will be described later.

An intake valve 17 for controlling air introduced from an intake manifold 2 to the combustion chamber 1*c* and an exhaust valve 19 for controlling emission from the combustion chamber 1*c* to an exhaust manifold 14 are provided in each cylinder. The intake valve 17 and the exhaust valve 19 are preferably electromagnetic valves and are driven in accordance with signals from the ECU 5. The ECU 5 controls the timing for opening and closing the intake valve 17 and the exhaust valve 19 in accordance with engine rotational speed, intake air temperature, engine water temperature and so on detected by various sensors. Thus, valve timing optimally adjusted to the operating conditions of the engine is achieved. By controlling the intake valve 17 and the exhaust valve 19, the amount of internal emission gas re-circulation (internal EGR) is adjusted. Thus, the combustion temperature is adjusted, decreasing the concentration of NOx contained in the exhaust gas.

A throttle valve (DBW (Drive-By-Wire) throttle valve, in this example) 3 is provided in the intake manifold 2. The throttle valve adjusts the amount of air flowing through the intake manifold. The throttle valve 3 is connected to an actuator (not shown) for controlling an opening angle ΘTH 7 of the throttle valve. The actuator is electrically connected to the ECU 5 to control the opening angle ΘTH 7, or the amount of intake air, in accordance with a signal from the ECU 5. The opening angle ΘTH 7 of the throttle valve 3 is set in accordance with an opening angle of an accelerator pedal (not shown) when the SI combustion is performed. The throttle valve 3 is almost fully opened when the HCCI combustion is performed.

An intake air pressure sensor 8 and an intake air temperature sensor 9 are provided downstream of the throttle valve 3 of the intake manifold 2 to detect the pressure PB within the intake manifold and the temperature TA within the intake manifold, respectively. The detected pressure PB and temperature TA are sent to the ECU 5.

A fuel injection valve 6 for each cylinder is provided in the intake manifold 2. Each fuel injection valve 6 is connected to a fuel pump (not shown). The amount of fuel supply to the engine 1 is determined by controlling a fuel injection time TOUT of the fuel injection valve 6 in accordance with a signal from the ECU 5.

An engine rotational speed sensor is attached to a crankshaft (not shown) of the engine 1. The engine rotational speed sensor outputs a CRK signal in accordance with rotation of the crankshaft. A TDC signal is also issued at a crank angle associated with a TDC position of the piston. Pulses of the CRK signal are counted by the ECU 5 to determine the rotational speed Ne of the engine.

An exhaust temperature sensor 20 is provided in the exhaust manifold 14 to detect the temperature of exhaust gas for each cylinder. The detected temperature is converted to a corresponding signal, which is then sent to the ECU 5.

Exhaust gas flows through the exhaust manifold 14 into an exhaust gas purification device 15. The exhaust gas purification device 15 includes a NOx absorption catalyst (LNC) and the like. An air-fuel ratio sensor (hereinafter referred to as a "LAF sensor") 16 is disposed upstream of the exhaust gas purification device 15 to output a signal corresponding to an air-fuel ratio of the exhaust gas. The LAF sensor is capable of detecting the air-fuel ratio over a wide range. The output of the LAF sensor is sent to the ECU 5.

The ECU 5 is typically a microcomputer having a CPU 5*a* for performing various control programs, a memory 5*b* including a RAM for temporarily storing programs and data required at run-time and providing working areas for operations by the CPU 5*a* and a ROM for storing programs and data, an input interface 5*c* for processing input signals from various sensors and an output interface 5*d* for sending control signals to each part of the engine.

The ECU 5 determines a requested torque PMECMD (engine torque requested by a driver) based on outputs of sensors. Specifically, a desired driving force is determined based on the accelerator pedal stroke and the vehicle speed. The requested torque is determined based on the desired driving force taking into account a shift position, a gear ratio, a torque converter efficiency and so on. A method for determining the requested torque is described in, for example, Japanese Patent Application Unexamined Publication (Kokai) No. H10-196424.

The ECU 5 determines the amount of fuel injection corresponding to the requested torque and then determines a timing for injecting the amount of fuel. The ECU 5 also identifies the operating conditions of the engine 1 based on outputs of sensors to determine a timing for igniting the spark plug 18, an opening angle ΘTH 7 of the throttle valve 3 and so on using control programs stored in the ROM. In accordance with such determination, the ECU 5 outputs signals through the output interface 5*d* to control the throttle valve 3, the fuel injection valve 6, the spark plug 18, the intake valve 17, the exhaust valve 19 and so on. Through such control, the combustion of the engine 1 can be switched between the HCCI combustion and the SI combustion.

Figure 2:
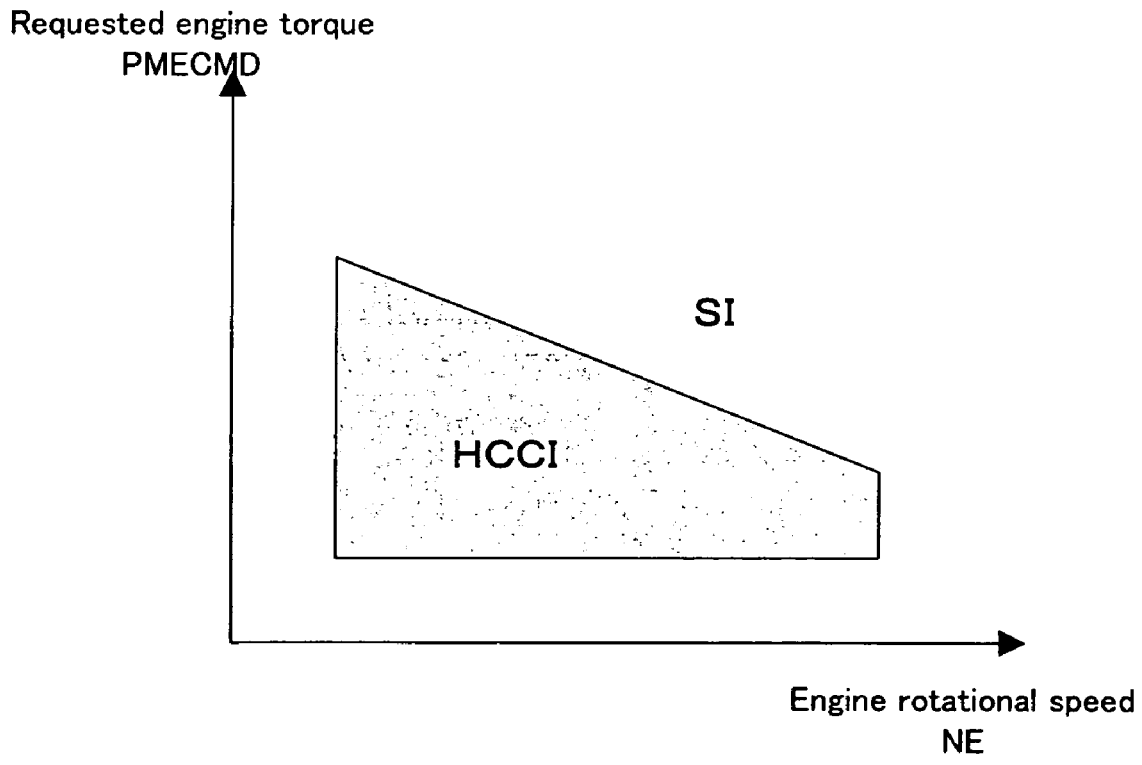
FIG. 2 shows operation ranges for compression ignition combustion and spark ignition combustion.

A map stored in the ROM within the ECU 5 is referred to based on the rotational speed NE of the engine 1 and the requested torque PMECMD to determine whether the operating conditions of the engine are within a range where the HCCI combustion is to be performed (hereinafter referred to as a "HCCI operation range") or within a range where the SI combustion is to be performed (hereinafter referred to as a "SI operation range"). One example of such a map is shown in FIG. 2. A range where the engine rotational speed NE is high and the requested torque PMECMD is high is specified as the HCCI operation range. A range where the engine is cold-started, the engine load is lower, and the engine load is higher is specified as the SI operation range.

In general, the internal combustion engine is controlled to perform fuel cut that stops fuel injection, for example, when the vehicle is decelerated. Fuel cut is performed so as to improve fuel efficiency. Such fuel cut decreases the temperature within the combustion chamber and the temperature of exhaust gas used for internal EGR. If the engine shifts to the compression ignition combustion immediately after such fuel-cut, the temperature within the combustion chamber may not reach a temperature required for compression self-ignition. As a result, engine misfire may occur even if the operating conditions of the engine are within the HCCI operation range. In order to prevent such engine misfire, the spark ignition combustion needs to be performed so as to warm up the combustion chamber immediately after the fuel-cut. After the temperature within the combustion chamber reaches a temperature required for the compression ignition combustion, the compression ignition combustion is performed.

Figure 3:
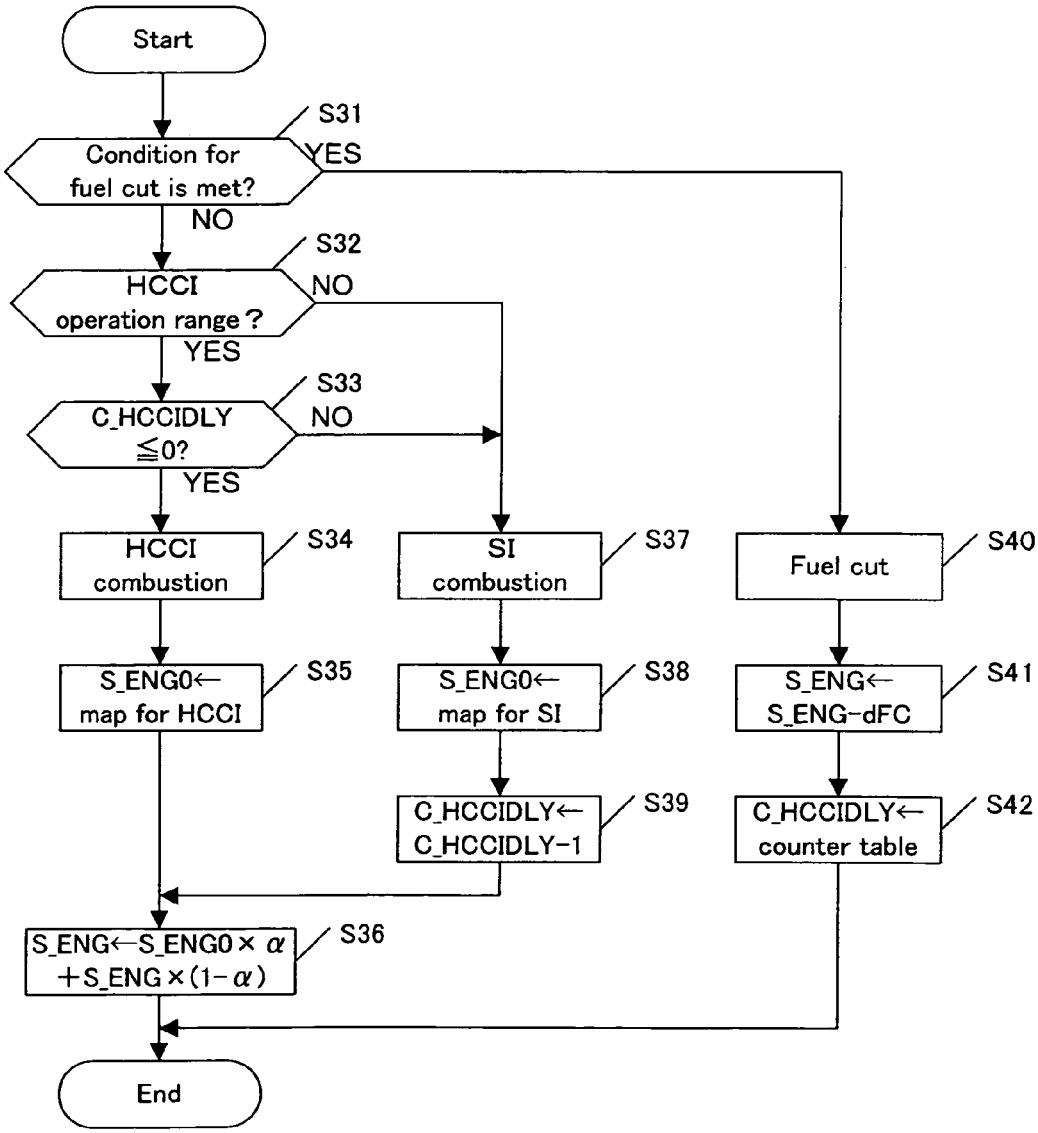
FIG. 3 is a flowchart of a process for retarding HCCI combustion after fuel cut in accordance with one embodiment of the present invention.

FIG. 3 is a flowchart of a process for implementing the above-described control in accordance with one embodiment of the present invention.

It is determined whether a predetermined condition for performing fuel-cut is met (S31). Specifically, the fuel-cut is performed, for example, when the engine rotation speed is high, or when the DBW 3 is fully closed, or when the intake air pressure PB is low, or when a traction control is performed.

Figure 4:
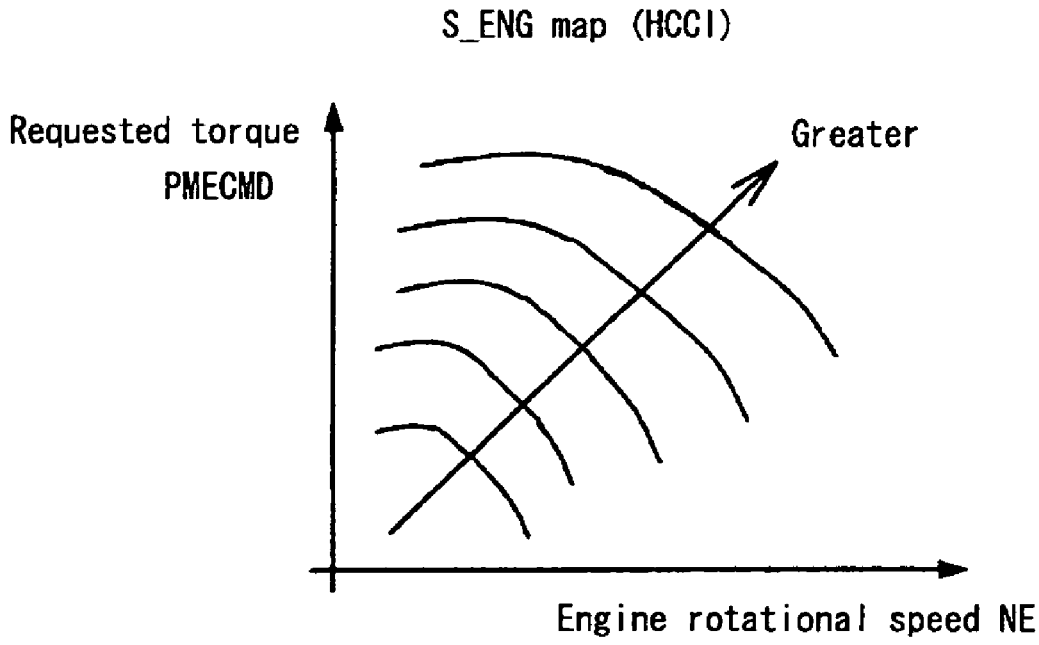
FIG. 4 shows a map used for estimating a temperature within a combustion chamber when HCCI combustion is performed.

If the condition for fuel cut is not met, it is determined whether the operating conditions of the engine (specifically, the engine rotational speed NE and the requested torque PMECMD) are in the HCCI operation range as shown in FIG. 2 (S32). If the operation conditions are in the HCCI operation range, it is determined whether a delay counter C_HCCIDLY, which is to be set in S42 described later, is zero (S33). Since the counter is zero when the routine is initially performed, the process proceeds to S34 to perform the HCCI combustion. The process refers to a map as shown in FIG. 4 based on the engine rotational speed NE and the requested torque PMECMD to determine S_ENG0 that is an estimated value for the temperature within the combustion chamber (S35). The map is established in such a manner that the estimated temperature S_ENG0 is greater as the engine rotational speed NE and the requested torque PMECMD increase. Such a map may be stored in the memory 5*b*. The estimated temperature S_ENG0 is corrected in accordance with the following equation (1).

$$S_ENG = S_ENG0 \times \alpha + S_ENG \times (1-\alpha) \quad (1)$$

As shown in the equation (1), a current value of the estimated temperature S_ENG is determined based on the estimated temperature S_ENG0, which is extracted from the above map, and a previous value of the estimated temperature S_ENG. By using the estimated temperature S_ENG0 and a previous value of the estimated temperature S_ENG, the temperature within the combustion chamber can be estimated not to abruptly change. The value of "α" is predetermined through an experiment or the like.

Figure 6:
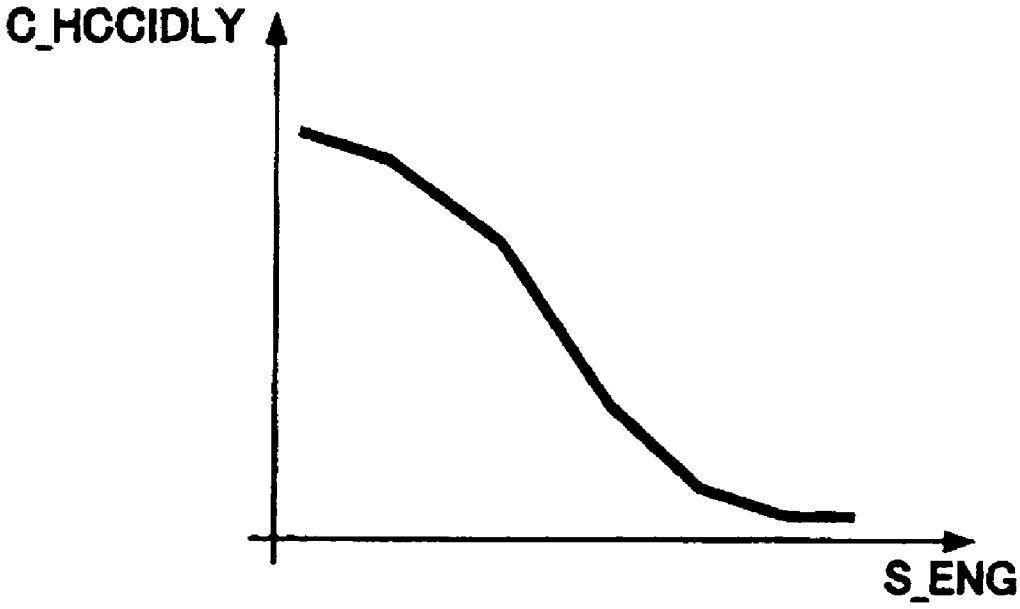
FIG. 6 shows a table used for determining a delay time for HCCI combustion after fuel cut.

If the condition for the fuel cut is met in S31, the fuel cut is performed (S40). It can be assumed that the temperature within the combustion chamber decreases at a constant rate due to heat radiation caused by the fuel cut. The estimated temperature S_ENG is decremented by a predetermined value dFC (S41). A table as shown in FIG. 6 is referred to based on the estimated temperature S_ENG to determine a counter value. The counter value corresponds to a time period during which the SI combustion is performed so as to raise the temperature within the combustion chamber up to a temperature that is required for performing the HCCI combustion. The determined counter value is set in the delay counter C_HCCIDLY (S42). Such a counter value for each estimated temperature S_ENG is predetermined through an experiment, simulation or the like and then specified in the map as shown in FIG. 6. Such a map may be stored in the memory 5*b*.

Figure 5:
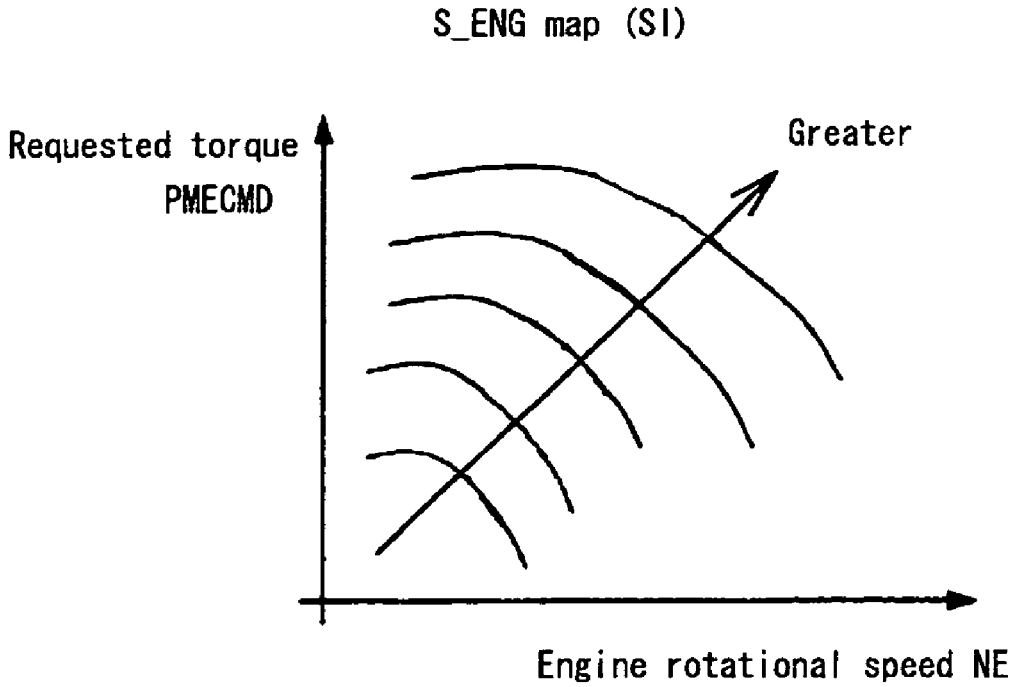
FIG. 5 shows a map used for estimating a temperature within a combustion chamber when SI combustion is performed.

If the condition for the fuel cut is not met in S31, the fuel cut is finished. If the counter C_HCCIDLY, which was set in S42, is not zero when the operation conditions of the engine at this time are within the HCCI operation range (that is, when the decision of S32 is "YES"), the decision in S33 is "NO". The process proceeds to S37, in which the SI combustion is performed. A map as shown in FIG. 5 is referred to based on the engine rotational speed NE and the requested torque PMECMD to determine the estimated value S_ENG0 (S38). As with the map in FIG. 4, the map of FIG. 5 is established in such a manner that the estimated temperature S_ENG0 is greater as the engine rotational speed NE and the requested torque PMECMD increase. The counter is decremented by one (S39). Thus, the SI combustion continues until the delay counter C_HCCIDLY reaches zero even when the operation conditions of the engine are within the HCCI operation range.

After the SI combustion continues over a time period corresponding to the counter value, the decision of S33 is "YES". Accordingly, the HCCI combustion is performed in S34.

It should be noted that the SI combustion is performed when the operating conditions of the engine are out of the HCCI operation range (that is, when the decision in S32 is "NO") regardless of the value of the delay counter C_HCCIDLY.

According to the above-described control, since the HCCI combustion is performed after the temperature within the combustion chamber rises, engine misfire is prevented and emission of NOx is reduced.

Figure 7:
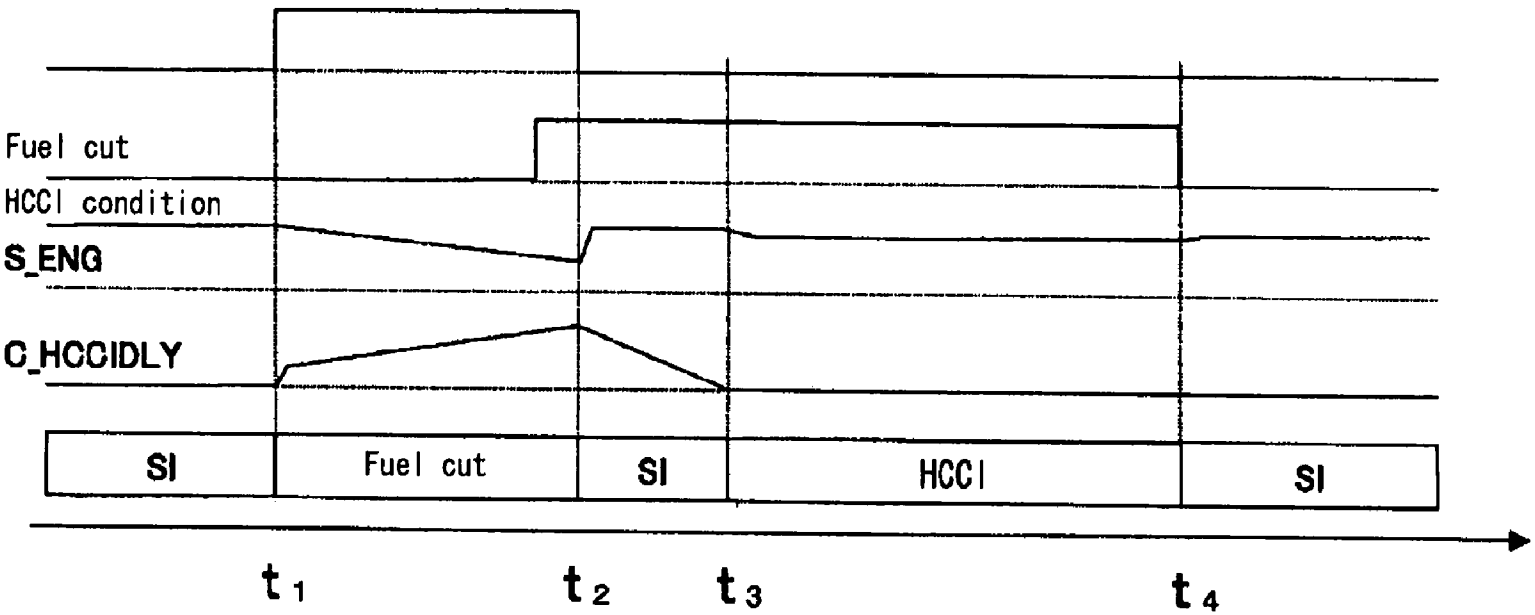
FIG. 7 shows a timing chart for various parameters.

FIG. 7 is a timing chart for showing behavior of each parameter when the above-described control is performed. The estimated temperature S_ENG is determined in S36 of FIG. 6 when the condition for fuel cut is not met in S31. If a flag indicating that the fuel cut is performed is set at time t1, the estimated temperature S_ENG is decremented by a predetermined value in S41. The counter C_HCCIDLY is set in accordance with the estimated temperature S_ENG in S42. When the fuel cut is finished at time t2, the SI combustion is performed in S37 because the counter C_HCCIDLY is not zero. Even when the operating conditions of the engine are within the HCCI operation range, the SI combustion is performed as long as the counter C_HCCIDLY is not zero. During the SI combustion, the counter C_HCCIDLY is decremented in S39. When the counter C_HCCIDLY reaches zero at time t3, the HCCI combustion is started in S34. The HCCI combustion is performed while the operation conditions of the engine are within the HCCI operation range.

Although specific embodiments of the present invention have been described above, the present invention is not limited to such specific embodiments. For example, although the above embodiments have been described referring to the inline four-cylinder engine, the invention can be applied to any other engines having a different number of cylinders.

The invention may be applied to an engine to be used in a vessel-propelling machine such as an outboard motor in which a crankshaft is disposed in the perpendicular direction.

What is claimed is:

1. A control apparatus for an internal combustion engine that is capable of switching between compression ignition combustion and spark ignition combustion, the control apparatus comprising a control unit configured to:

perform fuel cut out in accordance with operating conditions of the engine;

perform the spark ignition combustion over a time period after the fuel cut; and permit the compression ignition combustion after the time period elapses.

2. The control apparatus of claim 1, wherein the control unit is further configured to:

determine a temperature within a combustion chamber of the internal combustion engine immediately before the fuel cut is performed; and determine the time period based on the determined temperature within the combustion chamber.

3. The control apparatus of claim 2, further comprising a sensor for detecting a rotational speed of the internal combustion engine;

wherein the control unit is further configured to:

determine a requested engine torque; and estimate the temperature within the combustion chamber based on the rotational speed and the requested engine torque.

4. The control apparatus of claim 2, wherein the time period is determined so that the time period is longer as the temperature within the combustion chamber is lower.

5. The control apparatus of claim 1, wherein the time period is determined in accordance with a duration time of the fuel cut.

6. The control apparatus of claim 3, wherein the control unit is further configured to:

correct the estimated temperature so that the estimated temperature does not abruptly change.

7. A method for controlling an internal combustion engine that is capable of switching between compression ignition combustion and spark ignition combustion, the method comprising the steps of:

performing fuel cut out in accordance with operating conditions of the engine;

performing the spark ignition combustion over a time period after the fuel cut; and permitting the compression ignition combustion after the time period elapses.

8. The method of claim 7, further comprising the steps of:

determining a temperature within a combustion chamber of the internal combustion engine immediately before the fuel cut is performed; and determining the time period based on the determined temperature within the combustion chamber.

9. The method of claim 8, further comprising the steps of:

detecting a rotational speed of the internal combustion engine;

determining a requested engine torque; and estimating the temperature within the combustion chamber based on the rotational speed and the requested engine torque.

10. The method of claim 8, further comprising the step of determining the time period so that the time period is longer as the temperature within the combustion chamber is lower.

11. The method of claim 7, further comprising the step of determining the time period in accordance with a duration time of the fuel cut.

12. The method of claim 9, further comprising the step of correcting the estimated temperature so that the estimated temperature does not abruptly change.

13. A control apparatus for controlling an internal combustion engine that is capable of switching between compression ignition combustion and spark ignition combustion, the apparatus comprising:

means for performing fuel cut out in accordance with operating conditions of the engine;

means for performing the spark ignition combustion over a time period after the fuel cut; and means for permitting the compression ignition combustion after the time period elapses.

14. The apparatus of claim 13, further comprising:

means for determining a temperature within a combustion chamber of the internal combustion engine immediately before the fuel cut is performed; and means for determining the time period based on the determined temperature within the combustion chamber.

15. The apparatus of claim 14, further comprising:

means for detecting a rotational speed of the internal combustion engine;

means for determining a requested engine torque; and means for estimating the temperature within the combustion chamber based on the rotational speed and the requested engine torque.

16. The apparatus of claim 14, further comprising means for determining the time period so that the time period is longer as the temperature within the combustion chamber is lower.

17. The apparatus of claim 13, further comprising means for determining the time period in accordance with a duration time of the fuel cut.

18. The apparatus of claim 15, further comprising means for correcting the estimated temperature so that the estimated temperature does not abruptly change.

* * * * *